US008739989B2

(12) United States Patent
Liu et al.

(10) Patent No.: US 8,739,989 B2
(45) Date of Patent: Jun. 3, 2014

(54) COUNTERWEIGHT LOADING AND UNLOADING DEVICE AND MOVABLE CRANE

(75) Inventors: Huimin Liu, Hunan (CN); Munan Liu, Hunan (CN); Xin Zhang, Hunan (CN)

(73) Assignees: Hunan Sany Intelligent Control Equipment Co., Ltd. (CN); Sany Automobile Manufacture Co., Ltd. (CN)

( * ) Notice: Subject to any disclaimer, the term of this patent is extended or adjusted under 35 U.S.C. 154(b) by 61 days.

(21) Appl. No.: 13/380,359

(22) PCT Filed: Jun. 24, 2010

(86) PCT No.: PCT/CN2010/074370
§ 371 (c)(1), (2), (4) Date: Dec. 22, 2011

(87) PCT Pub. No.: WO2011/020374
PCT Pub. Date: Feb. 24, 2011

(65) Prior Publication Data

US 2012/0160795 A1 Jun. 28, 2012

(30) Foreign Application Priority Data

Aug. 19, 2009 (CN) ..... 2009 1 0166487

(51) Int. Cl.
*B66C 23/72* (2006.01)

(52) U.S. Cl.
USPC ..... 212/195

(58) Field of Classification Search
CPC ..... B66C 23/53; B66C 23/72; B66C 23/74; B66C 23/76; B66C 2700/0314; B66C 2700/0392
USPC ..... 212/195–198, 279, 178; 414/601, 602, 414/673, 719; 187/404, 405
See application file for complete search history.

(56) References Cited

U.S. PATENT DOCUMENTS 2,674,378 A * 4/1954 Meyer et al. ..... 212/178
4,402,413 A * 9/1983 Sickler ..... 212/178

(Continued)

FOREIGN PATENT DOCUMENTS

CN 2717914 A 8/2005
CN 1718529 A 1/2006

(Continued)

OTHER PUBLICATIONS

International Search Report for International application No. PCT/CN2010/074370 mailing date of Sep. 2, 2010.

(Continued)

*Primary Examiner* — Sang Kim
*Assistant Examiner* — Juan Campos, Jr.
(74) *Attorney, Agent, or Firm* — Cantor Colburn LLP

(57) ABSTRACT

A counterweight loading and unloading device and a movable crane have a freestanding pallet (10) with two ends whose upper end faces are used for holding a counterweight (61). The two ends of the freestanding pallet (10) are both equipped with a cavity, and at least one telescopic oil cylinder (11, 12, 13, and 14) is provided in the cavity. A fixed end of the telescopic oil cylinder is fixed with the freestanding pallet (10), and a telescopic end of the telescopic oil cylinder is coupled with a pallet lifting mechanism for lifting the freestanding pallet. The device is not limited by a planar space of a vehicle frame and a turntable height of the movable crane. An integral dimension of the movable crane is not increased, thus preventing integral dimension of the movable crane from exceeding a road traveling standard. The structure of the device is more compact, and the telescopic oil cylinder plays a role of the counterweight, thus enabling stress of the turntable to be more reasonable.

10 Claims, 6 Drawing Sheets

(56) References Cited

U.S. PATENT DOCUMENTS

| | | | | |
|---|---|---|---|---|
| 7,389,888 | B2 * | 6/2008 | Willim | 212/178 |
| 2007/0090074 | A1 * | 4/2007 | Willim | 212/178 |

FOREIGN PATENT DOCUMENTS

| | | | |
|---|---|---|---|
| CN | 201214605 | A | 4/2009 |
| CN | 201250068 | A | 6/2009 |
| CN | 101643182 | A | 2/2010 |
| DE | 268458 | A1 | 5/1989 |
| DE | 202005016815 | U1 | 4/2007 |
| FR | 2351906 | A1 | 12/1977 |
| FR | 2516491 | A | 5/1983 |

OTHER PUBLICATIONS

Extended European Search Report for Application No. 10809507.6; Date of Mailing: May 13, 2013.

* cited by examiner

COUNTERWEIGHT LOADING AND UNLOADING DEVICE AND MOVABLE CRANE

CROSS REFERENCE TO RELATED APPLICATIONS

The present application is the national phase of International Application No. PCT/CN2010/074370, titled "COUNTERWEIGHT LOADING AND UNLOADING DEVICE AND MOVABLE CRANE", filed on Jun. 24, 2010, which claims the benefit of priority to Chinese patent application No. 200910166487.X titled "COUNTERWEIGHT LOADING AND UNLOADING DEVICE AND MOVABLE CRANE", filed with the Chinese State Intellectual Property Office on Aug. 19, 2009. The entire disclosure thereof is incorporated herein by reference.

TECHNICAL FIELD OF THE INVENTION

The present invention relates to the technical field of cranes, particularly, to a counterweight mounting and dismounting device and a mobile crane having the same.

BACKGROUND OF THE INVENTION

As one kind of common engineering machinery, cranes mainly include rail-mounted cranes and non-rail-mounted mobile cranes. The mobile cranes include all-terrain cranes, wheel-mounted cranes, crawler cranes, etc. The mobile cranes have some advantages, for example, having good trafficability and flexibility, traveling fast, transferring quickly and starting to work immediately after arriving at the destination. Thus, the mobile cranes are used widely in engineering construction. However, compared with the rail-mounted cranes, the mobile cranes have smaller lifting capability due to the limitation of their own weight. In order to improve the stability of a mobile crane in working, a counterweight is generally mounted on the mobile crane.

The counterweight is a main structural member of the mobile crane, and the weight of the counterweight has a great influence on the stability and lifting capability of the crane. A small-tonnage mobile crane generally adopts the self-mounted counterweight structure, in which the counterweight is fixedly mounted on the body of the mobile crane, such that moves and works along with the mobile crane. For the small-tonnage mobile crane, since the lifting weight is relatively small, the required weight of the counterweight is relatively small; since the counterweight is fixedly mounted on the body of the crane and there is no need to dismount the counterweight, the small-tonnage mobile crane has a compact structure as a whole and moves flexibly.

The mobile crane is gradually developed to be large-tonnage, super large-tonnage, and thus weight and spatial size of the counterweight for the mobile crane is constantly increased, and the volume of components of the crane is becoming larger and larger. However, the provision of the counterweight is limited by the road standard and the carrying capability of a chassis of the crane. Thus, the counterweight can rationally be disposed merely in a limited space. Generally, the counterweight is provided as a movable component, that is, the mobile crane does not carry the counterweight while travelling and the counterweight is mounted to the body of the crane while working. A counterweight mounting and dismounting mechanism is used to mount the counterweight to the body of the crane and to dismount the counterweight from the body of the crane.

In the structure of a conventional counterweight mounting and dismounting mechanism, a left lifting oil cylinder and aright lifting oil cylinder are symmetrically provided at two sides of a turntable. Piston rods of the left lifting oil cylinder and the right lifting oil cylinder are both oriented upwardly, and a left movable pulley and a right movable pulley are provided at top ends of the piston rods respectively. A left fixed pulley and a right fixed pulley are symmetrically provided at two sides of the turntable. One end of a left wire rope, which is wound around a pulley block consisting of the left movable pulley and the left fixed pulley, is fixed to the turntable, and the other end thereof is provided with a left lifting hook. One end of a right wire rope, which is wound around a pulley block consisting of the right movable pulley and the right fixed pulley, is fixed to the turntable, and the other end thereof is provided with a right lifting hook. A left locking oil cylinder and a right locking oil cylinder are also provided at the two sides of the turntable.

The above counterweight mounting and dismounting mechanism includes the lifting oil cylinders, the locking oil cylinders, the lifting wire ropes and the pulley blocks. The method for mounting the counterweight includes the following steps that: after the mobile crane is in position and legs are set, such that the turntable is capable of rotating, the mobile crane lifts the desired counterweight by its own lifting device onto a counterweight pallet which is located in an appropriate position on the ground at one side of the frame of the crane, then, the turntable is rotated such that a tail portion of the turntable provided with the counterweight mounting and dismounting device is rotated to a position right above the counterweight, and then the left and right lifting hooks are hooked with the counterweight pallet and are fixed by pins; subsequently, the lifting oil cylinders are protruded upwardly to lift the counterweight pallet together with the counterweight, and the pin holes are ensured to be aligned by positioning with a wedge on the turntable and a positioning block on the counterweight pallet, the left locking oil cylinder and the right locking oil cylinder are operated to allow the pins to reach out and to insert into fixing holes provided in the counterweight pallet so as to fix the counterweight pallet; and the left lifting oil cylinder and the right lifting oil cylinder are retracted slightly to avoid the left lifting oil cylinder, the right lifting oil cylinder, the left wire rope and the right wire rope from bearing weight during a lifting operation. The method for dismounting the counterweight is performed in a reverse process of the method for mounting the counterweight.

In the counterweight mounting and dismounting mechanism with such a structure, the left lifting oil cylinder, the right lifting oil cylinder, the left locking oil cylinder and the right locking oil cylinder are all provided on the turntable of the mobile crane. The volume of components of the large-tonnage mobile crane and the super large-tonnage mobile crane are relatively large. In order to ensure that the overall size of the mobile crane does not exceed the roadway traveling standard, the arrangement of components is relatively compact and the space between components is very limited. Thus, if the left lifting oil cylinder, the right lifting oil cylinder, the left locking oil cylinder and the right locking oil cylinder are further provided on the turntable, the space on the turntable will be very small, which will affect the normal rotation of the turntable and affect the working performance of the mobile crane severely. In addition, since the left lifting oil cylinder, the right lifting oil cylinder, the left locking oil cylinder and the right locking oil cylinder all have relatively large weight, if the arrangement is not reasonable, the force condition of the turntable is not reasonable, which will substantially affect the stability of the mobile crane. Further-more, since the left lifting oil cylinder, the right lifting oil cylinder, the left locking oil cylinder and the right locking oil cylinder all have relatively large size, which results in an increased size of the whole mobile crane, and thus the overall size of the mobile crane could exceed the roadway travelling standard.

SUMMARY OF THE INVENTION

The object of the present invention is to provide a counterweight mounting and dismounting device disposed in a more reasonable position such that there is enough space on a turntable of a mobile crane and a more compact structure is achieved.

In order to realize the above object, the present invention provides a counterweight mounting and dismounting device including a freestanding pallet, with top surfaces of two ends of the pallet being used for placement of a counterweight. The two ends of the pallet are each provided with a cavity, and at least one telescopic oil cylinder is provided in each cavity. A fixed end of the telescopic oil cylinder is fixed to the pallet, and a telescopic end of the telescopic oil cylinder is coupled to a pallet lifting mechanism for lifting the pallet.

Preferably, the pallet lifting mechanism includes a fixed pulley, a movable pulley and a wire rope wound around the fixed pulley and the movable pulley. The movable pulley is fixed to the telescopic end of the telescopic oil cylinder, and the fixed pulley is fixed to the pallet. The wire rope is wound from a first end of the wire rope around the fixed pulley and the movable pulley in sequence to a second end of the wire rope. The first end of the wire rope is detachably coupled to an ear plate provided on a turntable of a mobile crane, and the second end of the wire rope is fixed to the pallet.

Preferably, the pallet lifting mechanism includes a fixed pulley and a wire rope wound around the fixed pulley. The fixed pulley is fixed to the pallet. A first end of the wire rope is detachably coupled to an ear plate provided on a turntable of a mobile crane, and a second end of the wire rope is fixed to the telescopic end of the telescopic oil cylinder.

Preferably, the pallet lifting mechanism includes a fixed chain wheel, a movable chain wheel and a chain wound around the fixed chain wheel and the movable chain wheel. The movable chain wheel is fixed to the telescopic end of the telescopic oil cylinder, and the fixed chain wheel is fixed to the pallet. The chain is wound from a first end of the chain around the fixed chain wheel and the movable chain wheel in sequence to a second end of the chain. The first end of the chain is detachably coupled to an ear plate provided on a turntable of a mobile crane, and the second end of the chain is fixed to the pallet.

Preferably, the pallet lifting mechanism includes a fixed chain wheel and a chain wound around the fixed chain wheel. The fixed chain wheel is fixed to the pallet. A first end of the chain is detachably coupled to an ear plate provided on a turntable of a mobile crane, and a second end of the chain is fixed to the telescopic end of the telescopic oil cylinder.

Preferably, the number of the telescopic oil cylinder in each cavity is one or two.

Preferably, at least one pallet fixing component is provided on the pallet, and a pin connection is formed between the pallet fixing component and a fixing pin provided at a rear end of the turntable of the mobile crane.

Preferably, the number of the pallet fixing component is four.

A mobile crane includes the above counterweight mounting and dismounting device.

Preferably, at least one fixing pin is provided at a rear end of a turntable of the mobile crane.

The counterweight mounting and dismounting device according to the present invention includes the freestanding pallet, with top surfaces of two ends of the pallet being used for placement of the counterweight. The two ends of the pallet are each provided with the cavity extending along the direction of the length of the pallet, and at least one telescopic oil cylinder is provided in each cavity. The fixed end of the telescopic oil cylinder is fixed to the pallet, and the telescopic end of the telescopic oil cylinder is coupled to the pallet lifting mechanism for lifting the pallet. The pallet lifting mechanism may be a pulley mechanism which includes the fixed pulley, the movable pulley and the wire rope wound around the fixed pulley and the movable pulley. The movable pulley is fixed to the telescopic end of the telescopic oil cylinder, and the fixed pulley is fixed to the pallet. The wire rope is wound from a first end of the wire rope around the fixed pulley and the movable pulley in sequence to a second end of the wire rope. The first end of the wire rope is detachably coupled to the ear plate provided on the turntable of the mobile crane, and the second end of the wire rope is fixed to the pallet.

The method for mounting the counterweight with the counterweight mounting and dismounting device of such a structure includes the following steps that: after the mobile crane is in position and legs are set, such that the turntable is capable of rotating, the mobile crane lifts the pallet by its own lifting device and places the pallet to a position between the legs at one side of the mobile crane; the mobile crane places a desired counterweight on the top surfaces of the two ends of the pallet by its own lifting device; after the counterweight is placed properly, the turntable is rotated such that a rear end of the turntable is rotated to a position right above the pallet; the first end of the wire rope is connected to the ear plate provided on the turntable; the telescopic oil cylinders are driven, so that the telescopic ends of the telescopic oil cylinders all protrude towards the ends of the pallet, so as to drive the movable pulleys to move towards the ends of the pallet; the wire rope is tightened during the movement of the movable pulley because the first end of the wire rope is fixed to the turntable and the second end of the wire rope is fixed to the pallet, and the pallet and the counterweight placed on the pallet are lifted gradually under the pulling force of the wire rope; when the pallet and the counterweight are lifted to a desired position, the pallet fixing device provided on the pallet is fixedly coupled to the turntable so as to fix the pallet and the counterweight. The process of dismounting the counterweight is contrary to the above-mentioned process of mounting the counterweight.

For such a structure of the counterweight mounting and dismounting device, since the cavities extending along the direction of the length of the pallet are provided in the pallet, and the telescopic oil cylinders for providing lifting power are provided in the cavities of the pallet, the telescopic oil cylinders no longer take up the space of the turntable, and the counterweight mounting and dismounting device is no longer limited by the plane space of the frame and the height of the turntable of the mobile crane, so that the normal rotation of the turntable can not be affected, thereby ensuring the working performance of the mobile crane. The counterweight mounting and dismounting device will not increase the overall size of the mobile crane so that the overall size of the mobile crane can not exceed the roadway travelling standard, and the structure of the whole machine is more compact. Due to their own weights, the telescopic oil cylinders provided in the pallet can also function as counterweights, so that the force condition of the turntable is more reasonable, which effectively improves the stability of the mobile crane. The pallet lifting device adopts the structure of the wire rope and the pulley block, in which a flexible connection is provided, and thus the on-site operation is more simple, safe and reliable.

A mobile crane is further provided in the present invention, which includes the above counterweight mounting and dismounting device. Since the counterweight mounting and dismounting device brings about the above technical effects, the mobile crane with the above counterweight mounting and dismounting device also brings about corresponding technical effects.

Figure 1:
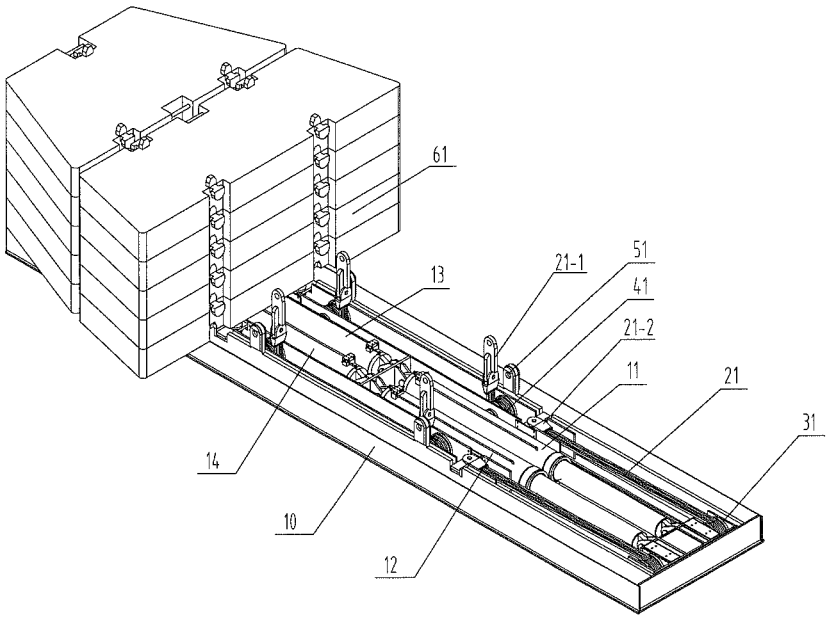
FIG. 1 is a perspective schematic view of a structure of a specific embodiment of a counterweight mounting and dismounting device according to the present invention.

REFERENCE NUMERALS IN FIGS. 1 TO 7 pallet 10, first telescopic oil cylinder 11, second telescopic oil cylinder 12, third telescopic oil cylinder 13, fourth telescopic oil cylinder 14, wire rope or chain 21, first rope coupling 21-1, second rope coupling 21-2, movable pulley 31, fixed pulley or chain wheel 41, pallet fixing component 51, counterweight 61, turntable 70, ear plate 71, fixing pin 72.

DETAILED DESCRIPTION OF THE INVENTION

The object of the present invention is to provide a counterweight mounting and dismounting device disposed in a more reasonable position such that there is enough space on a turntable of a mobile crane and a more compact structure is achieved. Another object of the present invention is to provide a mobile crane.

The present invention will be described below in conjunction with drawings. The following description is only exemplary and explanatory, and has no any limitation to the protection scope of the present invention.

Referring to FIG. 1, a perspective schematic view of a structure of a specific embodiment of a counterweight mounting and dismounting device according to the present invention is shown.

As shown in FIG. 1, the counterweight mounting and dismounting device according to the present invention includes a freestanding pallet 10. Top surfaces of two ends of the pallet 10 are used for the placement of the counterweight 61. The two ends of the pallet 10 are each provided with a cavity extending along the direction of the length of the pallet 10, and at least one telescopic oil cylinder is provided in each cavity. A fixed end of each telescopic oil cylinder is fixed with the pallet 10, and a telescopic end of each telescopic oil cylinder is connected with a pallet lifting mechanism for lifting the pallet 10.

In one specific embodiment, two telescopic oil cylinders are provided in each cavity of respective end of the pallet 10. As shown in FIG. 1, the first telescopic oil cylinder 11 and the second telescopic oil cylinder 12 are provided in the cavity of one end of the pallet 10, and the third telescopic oil cylinder 13 and the fourth telescopic oil cylinder 14 are provided in the cavity of the other end of the pallet 10. Telescopic ends of the first telescopic oil cylinder 11, the second telescopic oil cylinder 12, the third telescopic oil cylinder 13 and the fourth telescopic oil cylinder 14 are all provided toward the ends of the pallet 10. Alternatively, only one telescopic oil cylinder may be provided in each cavity of respective end of the pallet 10. That is, in the present invention, the number of the telescopic oil cylinder provided in each cavity is not limited.

The telescopic ends of the first telescopic oil cylinder 11, the second telescopic oil cylinder 12, the third telescopic oil cylinder 13 and the fourth telescopic oil cylinder 14 are all connected to the pallet lifting mechanism. The pallet lifting mechanism connected with the first telescopic oil cylinder 11 is described as an example as follows.

In one specific embodiment, the pallet lifting mechanism connected with the telescopic end of the first telescopic oil cylinder 11 includes a movable pulley 31, a fixed pulley 41 and a wire rope 21 wound around the movable pulley 31 and the fixed pulley 41. The movable pulley 31 is fixed to the telescopic end of the first telescopic oil cylinder 11, such that the movable pulley 31 may move back and forth along with the telescopic end of the first telescopic oil cylinder 11 in the direction of the length of the pallet 10. The fixed pulley 41 is fixed to the pallet 10. The wire rope 21 is wound from a first end of the wire rope 21 around the fixed pulley 41 and the movable pulley 31 in sequence to a second end of the wire rope 21, with the first end of the wire rope 21 being detachably connected with an ear plate 71 provided on a turntable 70 of a mobile crane, and the second end of the wire rope 21 being fixed to the pallet 10. In a preferred embodiment, in order to facilitate connecting and fixing of the first end and the second end of the wire rope 21, a first rope coupling 21-1 and a second rope coupling 21-2 are provided at the first end and the second end of the wire rope 21, respectively. The first rope coupling 21-1 and the second rope coupling 21-2 may be connected with the ear plate of the turntable and the pallet 10 by pin connections, respectively.

Figure 2:
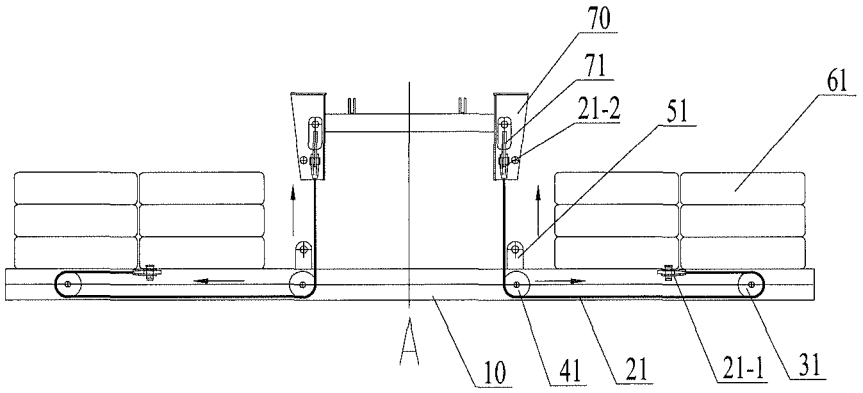
FIG. 2 is a schematic view illustrating the working principle of the counterweight mounting and dismounting device according to the present invention.

For the winding direction of the wire rope 21, please refer to FIG. 2, which is a schematic view illustrating the working principle of the counterweight mounting and dismounting device according to the present invention. As shown in FIG. 2, the second end of the wire rope 21 is fixed to the pallet 10, and the wire rope 21 is sequentially wound around the movable pulley 31, the fixed pulley 41 to the first end of the wire rope 21. It is understandable that, when a stroke of the first telescopic oil cylinder 11 is L, a displacement of the wire rope 21 is 2L, i.e. the vertical displacement of the pallet 10 is also 2L. As a result, a shorter displacement of the first telescopic oil cylinder 11 allows the pallet 10 to be lifted by a longer displacement.

In a preferred embodiment, in order to ensure that the wire rope 21 is capable of bearing enough strength, a plurality of wire ropes may be used. The number of the wire ropes 21 may be selected as desired.

The pallet lifting mechanisms respectively connected with the telescopic ends of the second telescopic oil cylinder 12, the third telescopic oil cylinder 13 and the fourth telescopic oil cylinder 14 are similar to the pallet lifting mechanism connected with the first telescopic oil cylinder 11, which will not be described in detail herein.

The pallet 10 and the counterweight 61 may be lifted to a desired height by the above pallet lifting mechanism. In order to fix the pallet 10 to the turntable 70 of the mobile crane, in a preferred embodiment, a pallet fixing component 51 is provided on the pallet. The pallet fixing component 51 may be a connecting plate with a pin hole, and a fixing pin 72 engaged with the pallet fixing component 51 is provided on the turntable 70 of the mobile crane accordingly. The fixing pin 72 may be fixedly connected with the pallet fixing component 51 by a pin connection. In a further embodiment, in order to ensure the stability of the connection between the pallet 10 and the turntable 70 of the mobile crane, four pallet fixing components 51 are provided on the pallet 10 symmetrically. Accordingly, four fixing pins 72 are also provided on the turntable 70 symmetrically.

The working principle of the counterweight mounting and dismounting device according to the present invention will be described as follows.

Figure 3:
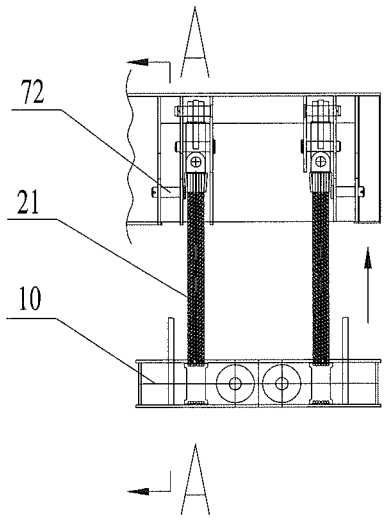
FIG. 3 is a sectional schematic view taken along line A in FIG. 2.
Figure 4:
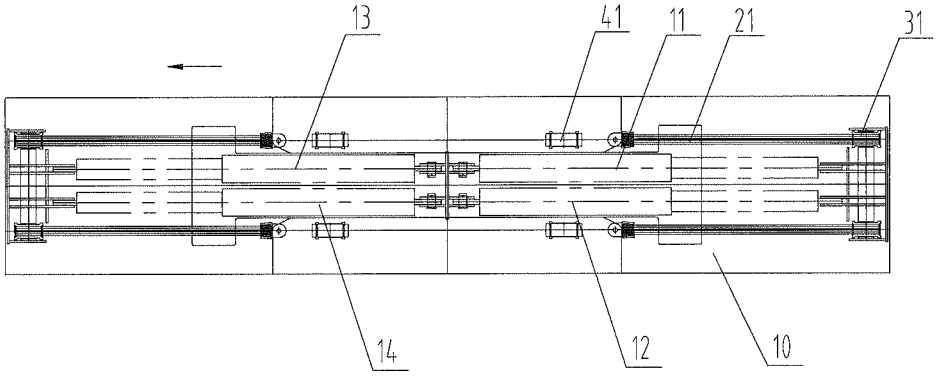
FIG. 4 is a top schematic view of the structure of FIG. 2.
Figure 5:
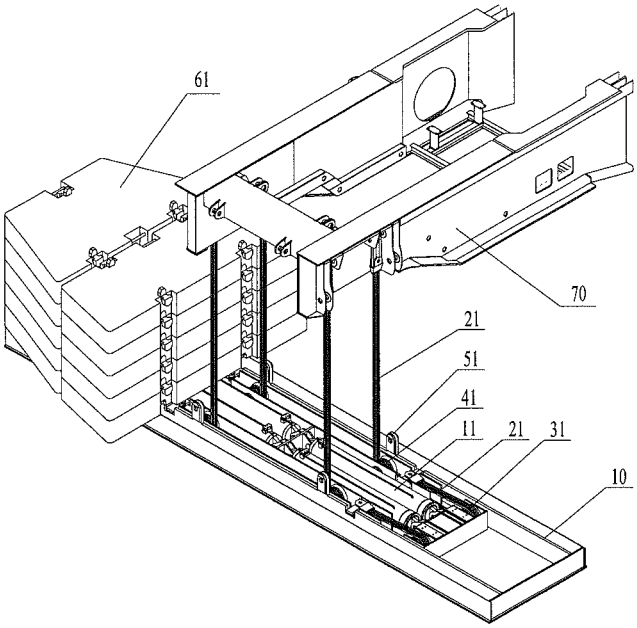
FIG. 5 is a structural schematic view of the counterweight mounting and dismounting device in a lifting position according to the present invention.
Figure 6:
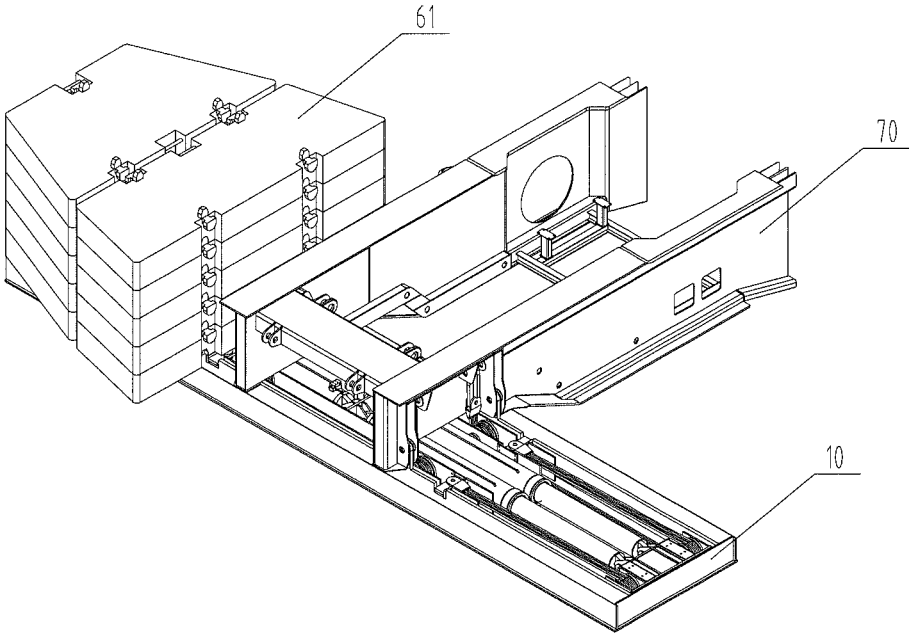
FIG. 6 is a structural schematic view of the counterweight mounting and dismounting device in a working position according to the present invention.
Figure 7:
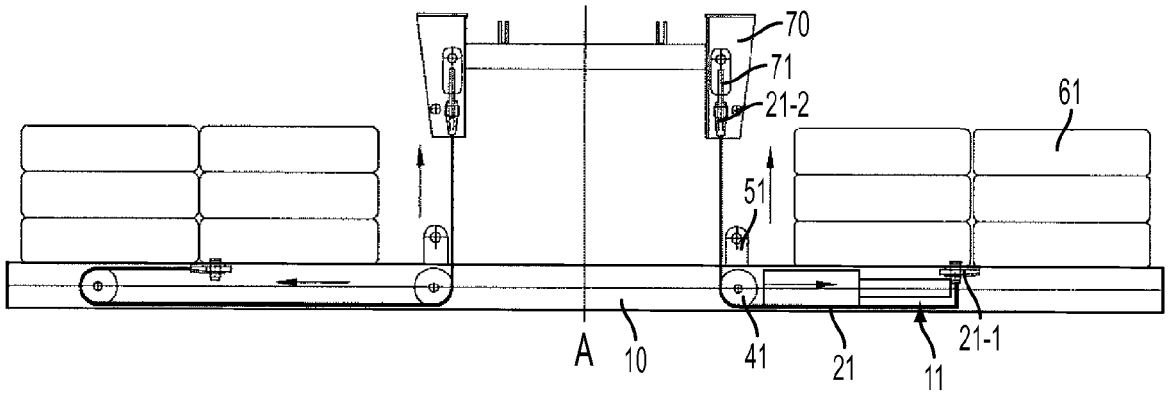
FIG. 7 is a schematic view illustrating the working principle of an alternative embodiment of the counterweight mounting and dismounting device.

Referring to FIGS. 2-7, FIG. 2 is a schematic view illustrating the working principle of the counterweight mounting and dismounting device according to the present invention; FIG. 3 is a sectional schematic view taken along line A in FIG. 2; FIG. 4 is a top schematic view of the structure of FIG. 2; FIG. 5 is a structural schematic view of the counterweight mounting and dismounting device in a lifting position according to the present invention; FIG. 6 is a structural schematic view of the counterweight mounting and dismounting device in a working position according to the present invention; and FIG. 7 is a schematic view illustrating the working principle of an alternative embodiment of the counterweight mounting and dismounting device.

A method for mounting a counterweight with the counterweight mounting and dismounting device according to the present invention includes the following steps that: after the mobile crane is in position and legs are set, such that the turntable 70 is capable of rotating, the mobile crane lifts the pallet 10 by its own lifting device and places the pallet 10 to a position between legs at one side of the mobile crane; the mobile crane places a desired counterweight 61 on the top surfaces of the two ends of the pallet 10 by its own lifting device; after the counterweight 61 is placed properly, the turntable 70 is rotated such that a rear end of the turntable 70 is rotated to a position right above the pallet 10; the first rope coupling 21-1 of the first end of the wire rope 21 is connected to the ear plate 71 provided on the turntable 70; the first telescopic oil cylinder 11, the second telescopic oil cylinder 12, the third telescopic oil cylinder 13 and the fourth telescopic oil cylinder 14 are driven, so that the telescopic ends of the first telescopic oil cylinder 11, the second telescopic oil cylinder 12, the third telescopic oil cylinder 13 and the fourth telescopic oil cylinder 14 all protrude towards the ends of the pallet 10, so as to drive the movable pulleys 31 to move towards the ends of the pallet 10; the wire rope 21 is tightened during the movement of the movable pulley 31 because the first end of the wire rope 21 is fixed to the turntable 70 and the second end of the wire rope 21 is fixed to the pallet 10, and the pallet 21 and the counterweight 61 placed on the pallet 21 are lifted gradually under the pulling force of the wire rope 21; when the pallet 21 and the counterweight 61 are lifted to a desired position, the pallet fixing device 51 provided on the pallet 21 is fixedly coupled to the fixing pin 72 provided on the turntable 70 so as to fix the pallet 21 and the counterweight 61. The process of dismounting the pallet 21 and the counterweight 61 is contrary to the above-mentioned process, which will not be described in detail herein.

The technical effects of the counterweight mounting and dismounting device according to the present invention are described hereinafter.

For the counterweight mounting and dismounting device according to the present invention, since the cavities extending along the direction of the length of the pallet 10 are provided in the pallet 10, and the first telescopic oil cylinder 11, the second telescopic oil cylinder 12, the third telescopic oil cylinder 13 and the fourth telescopic oil cylinder 14 for providing lifting power are provided in the cavities of the pallet 10, the telescopic oil cylinders no longer take up the space of the turntable 70, and the counterweight mounting and dismounting device is no longer limited by the plane space of the frame and the height of the turntable of the mobile crane, so that the normal rotation of the turntable 70 can not be affected, thereby ensuring the working performance of the mobile crane. The counterweight mounting and dismounting device will not increase the overall size of the mobile crane, so that the overall size of the mobile crane can not exceed the roadway travelling standard, and the structure of the whole machine is more compact.

Due to their own weights, the first telescopic oil cylinder 11, the second telescopic oil cylinder 12, the third telescopic oil cylinder 13 and the fourth telescopic oil cylinder 14 provided in the pallet 10 can also function as counterweights, so that the force condition of the turntable 70 is more reasonable, which effectively improves the stability of the mobile crane.

The pallet lifting device adopts the structure of the wire rope 21 and the pulley block, in which a flexible connection is provided, and thus the on-site operation is more simple, safe and reliable.

The pallet lifting mechanism in the above embodiment only is a pallet lifting mechanism with a specific structure according to the present invention, but the present invention is not limited thereto. Pallet lifting mechanisms that lift the pallet by protruding and retracting of the telescopic oil cylinder should be deemed to fall into the protection scope of the present invention, for example, a structure with only one fixed pulley.

The pallet lifting mechanism with only one fixed pulley will be described briefly hereinafter.

The pallet lifting mechanism connected to the telescopic end of the first telescopic oil cylinder 11 includes a fixed pulley and a wire rope wound around the fixed pulley. The position of the fixed pulley is similar to the position of the fixed pulley 41 in the above embodiment. Specifically, the fixed pulley is fixed to the pallet 10. A first end of the wire rope is detachably connected with the ear plate 71 provided on the turntable 70 of the mobile crane, and a second end of the wire rope is fixed to the telescopic end of the first telescopic oil cylinder 11. In a preferred embodiment, in order to facilitate connecting and fixing of the first end and the second end of the wire rope, rope couplings are provided at the first end and the second end of the wire rope, respectively.

In such a structure of the pallet lifting mechanism, when the stroke of the telescopic end of the first telescopic oil cylinder 11 is L, the displacement of the wire rope is also L, i.e. the vertical displacement of the pallet 10 is also L. The other specific implementation processes in the embodiment is similar to that in the above embodiment, which will not be described in detail herein.

The pallet lifting mechanism in the above embodiments includes a pulley block and a wire rope, but the counterweight mounting and dismounting device according to the present invention is not limited thereto. The pallet lifting mechanism may also include a chain wheel block and a chain, which will be described in the following embodiment briefly hereinafter.

The pallet lifting mechanism connected with the first telescopic oil cylinder 11 is described as an example as follows.

In one specific embodiment, the pallet lifting mechanism connected with the telescopic end of the first telescopic oil cylinder 11 includes a movable chain wheel, a fixed chain wheel and a chain wound around the movable chain wheel and the fixed chain wheel. The movable chain wheel is fixed to the telescopic end of the first telescopic oil cylinder 11, such that the movable chain wheel may move back and forth along with the telescopic end of the first telescopic oil cylinder 11 in the direction of the length of the pallet 10. The fixed chain wheel is fixed to the pallet 10. The chain are wounded from a first end of the chain around the fixed chain wheel and the movable chain wheel in sequence to a second end of the chain, with the first end of the chain being detachably coupled to the ear plate 71 provided on the turntable 70 of the mobile crane, and the second end of the chain being fixed to the pallet 10.

It is understandable that, when a stroke of the first telescopic oil cylinder 11 is L, a displacement of the chain is 2L, i.e. the vertical displacement of the pallet 10 is also 2L. Thus, a shorter displacement of the first telescopic oil cylinder 11 allows the pallet 10 to be lifted by a longer displacement.

The other implementation processes in the embodiment is similar to that in the above embodiments, which will not be described in detail herein.

The structure of the chain wheel block is not limited to the structure described above. Pallet lifting mechanisms that lift the pallet by protruding and retracting of the telescopic oil cylinder should be deemed to fall into the protection scope of the present invention, for example, a structure with only one fixed chain wheel.

The pallet lifting mechanism with only one fixed chain wheel will be described briefly hereinafter.

The pallet lifting mechanism connected to the telescopic end of the first telescopic oil cylinder 11 includes a fixed chain wheel, similar to, and schematically represented as fixed pulley 41, and a chain, similar to, and schematically represented as wire rope 21, wound around the fixed chain wheel. The position of the fixed chain wheel is similar to the position of the fixed chain wheel in the above embodiment. Specifically, the fixed chain wheel is fixed to the pallet 10. A first end of the chain is detachably connected with the ear plate 71 provided on the turntable 70 of the mobile crane, and a second end of the chain is fixed to the telescopic end of the first telescopic oil cylinder 11. In such a structure of the pallet lifting mechanism, when the stroke of the telescopic end of the first telescopic oil cylinder 11 is L, the displacement of the chain is also L, i.e. the vertical displacement of the pallet 10 is also L. The other specific implementation processes in the embodiment is similar to that in the above embodiments, which will not be described in detail herein.

A mobile crane is further provided in the present invention, which includes the above counterweight mounting and dismounting device. Since the counterweight mounting and dismounting device brings about the above technical effects, the mobile crane with the above counterweight mounting and dismounting device also brings about corresponding technical effects, which will not be described in detail herein.

The above description is only directed to the preferred embodiments of the present invention. It should be noted that, for the person skilled in the art, many improvements, modifications or variations may be made without deviating from the principle of the present invention, for example, a cutting ring can be a portion of the respective pipe, and can also be a freestanding component with high wear-resisting performance. These improvements, modifications or variations should be deemed to fall into the protection scope of the present invention.

What is claimed is:

1. A counterweight mounting and dismounting device, comprising a freestanding pallet, with top surfaces of two ends of the pallet being used for placement of a counterweight, wherein the two ends of the pallet are each provided with a cavity, at least one telescopic oil cylinder is provided in each cavity, a fixed end of the telescopic oil cylinder is fixed to the pallet, and a telescopic end of the telescopic oil cylinder is coupled to a pallet lifting mechanism for lifting the pallet.

2. The counterweight mounting and dismounting device according to claim 1, wherein the pallet lifting mechanism comprises a fixed pulley, a movable pulley and a wire rope wound around the fixed pulley and the movable pulley, the movable pulley is fixed to the telescopic end of the telescopic oil cylinder, the fixed pulley is fixed to the pallet, the wire rope is wound from a first end of the wire rope around the fixed pulley and the movable pulley in sequence to a second end of the wire rope, the first end of the wire rope is detachably coupled to an ear plate provided on a turntable of a mobile crane, and the second end of the wire rope is fixed to the pallet.

3. The counterweight mounting and dismounting device according to claim 1, wherein the pallet lifting mechanism comprises a fixed pulley and a wire rope wound around the fixed pulley, the fixed pulley is fixed to the pallet, a first end of the wire rope is detachably coupled to an ear plate provided on a turntable of a mobile crane, and a second end of the wire rope is fixed to the telescopic end of the telescopic oil cylinder.

4. The counterweight mounting and dismounting device according to claim 1, wherein the pallet lifting mechanism comprises a fixed chain wheel, a movable chain wheel and a chain wound around the fixed chain wheel and the movable chain wheel, the movable chain wheel is fixed to the telescopic end of the telescopic oil cylinder, the fixed chain wheel is fixed to the pallet, the chain is wound from a first end of the chain around the fixed chain wheel and the movable chain wheel in sequence to a second end of the chain, the first end of the chain is detachably coupled to an ear plate provided on a turntable of a mobile crane, and the second end of the chain is fixed to the pallet.

5. The counterweight mounting and dismounting device according to claim 1, wherein the pallet lifting mechanism comprises a fixed chain wheel and a chain wound around the fixed chain wheel, the fixed chain wheel is fixed to the pallet, a first end of the chain is detachably coupled to an ear plate provided on a turntable of a mobile crane, and a second end of the chain is fixed to the telescopic end of the telescopic oil cylinder.

6. The counterweight mounting and dismounting device according to claim 1, wherein the number of the telescopic oil cylinder in each cavity is one or two.

7. The counterweight mounting and dismounting device according to claim 6, wherein at least one pallet fixing component is provided on the pallet, and a pin connection is formed between the pallet fixing component and a fixing pin provided at a rear end of the turntable of the mobile crane.

8. The counterweight mounting and dismounting device according to claim 7, wherein the number of the pallet fixing components is four.

9. A mobile crane, comprising the counterweight mounting and dismounting device according to claim 1.

10. The mobile crane according to claim 9, wherein at least one fixing pin is provided at a rear end of a turntable of the mobile crane.

* * * * *